US011118856B2

(12) United States Patent
Dunham

(10) Patent No.: US 11,118,856 B2
(45) Date of Patent: Sep. 14, 2021

(54) SELF-CLEANING FIREARMS SUPPRESSOR

(71) Applicant: DK Precision Outdoor, LLC, White City, OR (US)

(72) Inventor: Michael Nathan Dunham, Central Point, OR (US)

(73) Assignee: DK Precision Outdoor, LLC, White City, OR (US)

( * ) Notice: Subject to any disclaimer, the term of this patent is extended or adjusted under 35 U.S.C. 154(b) by 472 days.

(21) Appl. No.: 16/200,240

(22) Filed: Nov. 26, 2018

(65) Prior Publication Data

US 2019/0249942 A1 Aug. 15, 2019

Related U.S. Application Data

(60) Provisional application No. 62/628,568, filed on Feb. 9, 2018.

(51) Int. Cl.
*F41A 21/30* (2006.01)
*F41A 29/00* (2006.01)

(52) U.S. Cl.
CPC ..... *F41A 21/30* (2013.01); *F41A 29/00* (2013.01)

(58) Field of Classification Search
CPC ..... F41A 21/30; F41A 21/32; F41A 21/34; F41A 21/38; F41A 29/00
See application file for complete search history.

(56) References Cited

U.S. PATENT DOCUMENTS 846,482 A * 3/1907 Layne ..... B21C 37/157 228/144
1,342,978 A * 6/1920 Young ..... F41A 21/30 89/14.3
RE17,299 E * 5/1929 Maxim ..... F01N 1/12 181/279
1,732,943 A * 10/1929 Maxim ..... F01N 1/12 181/269
1,812,413 A * 6/1931 Reynolds ..... F01N 13/1838 181/279
2,375,617 A * 5/1945 Bourne ..... F41A 21/30 181/223
4,907,488 A 3/1990 Seberger
5,029,512 A 7/1991 Latka
6,109,387 A 8/2000 Boretti
7,789,008 B2 * 9/2010 Petersen ..... F41A 21/30 89/14.4
7,856,914 B2 * 12/2010 Shults ..... F41A 21/30 89/14.4
8,196,701 B1 6/2012 Oliver
8,292,025 B1 * 10/2012 Woodell ..... F41A 21/30 181/223
8,453,789 B1 6/2013 Honigmann et al.
(Continued)

*Primary Examiner* — Derrick R Morgan
(74) *Attorney, Agent, or Firm* — McCoy Russell LLP

(57) ABSTRACT

Methods and systems are provided for a firearms suppressor that comprises a self-cleaning function. In one example the firearms suppressor may include a diffusor circumferentially surrounded by a blast chamber and a scrolled sleeve enclosing the inner core of the firearms suppressor. The combination of the said elements may mitigate accumulation of debris within a projectile path of the firearms suppressor and enable extended operation of the firearms suppressor before cleaning is desired.

18 Claims, 7 Drawing Sheets

(56) References Cited

U.S. PATENT DOCUMENTS

| | | | | |
|---|---|---|---|---|
| 8,505,680 | B2 * | 8/2013 | Dueck | F41A 21/30 181/223 |
| 8,561,757 | B1 | 10/2013 | Edsall | |
| 8,567,556 | B2 * | 10/2013 | Dueck | F41A 21/325 181/223 |
| 8,739,922 | B2 * | 6/2014 | Wirth | F41A 21/30 181/223 |
| 9,115,949 | B1 | 8/2015 | Morrison | |
| 9,194,640 | B2 * | 11/2015 | Wirth | F41A 21/30 |
| 10,330,420 | B2 * | 6/2019 | Kunsky | F41A 21/325 |
| 2010/0126334 | A1 * | 5/2010 | Shults | F41A 21/30 89/14.4 |
| 2013/0168181 | A1 * | 7/2013 | Wirth | F41A 21/30 181/223 |
| 2013/0180797 | A1 * | 7/2013 | Dueck | F41A 21/34 181/223 |
| 2014/0231168 | A1 * | 8/2014 | Dueck | F41A 21/34 181/223 |
| 2014/0374189 | A1 * | 12/2014 | Young | F41A 21/30 181/223 |
| 2015/0001002 | A1 * | 1/2015 | Wirth | F41A 21/30 181/223 |
| 2016/0010935 | A1 * | 1/2016 | Clarke | F41A 21/34 89/14.4 |
| 2020/0309478 | A1 * | 10/2020 | Meaux | F41A 21/30 |

* cited by examiner

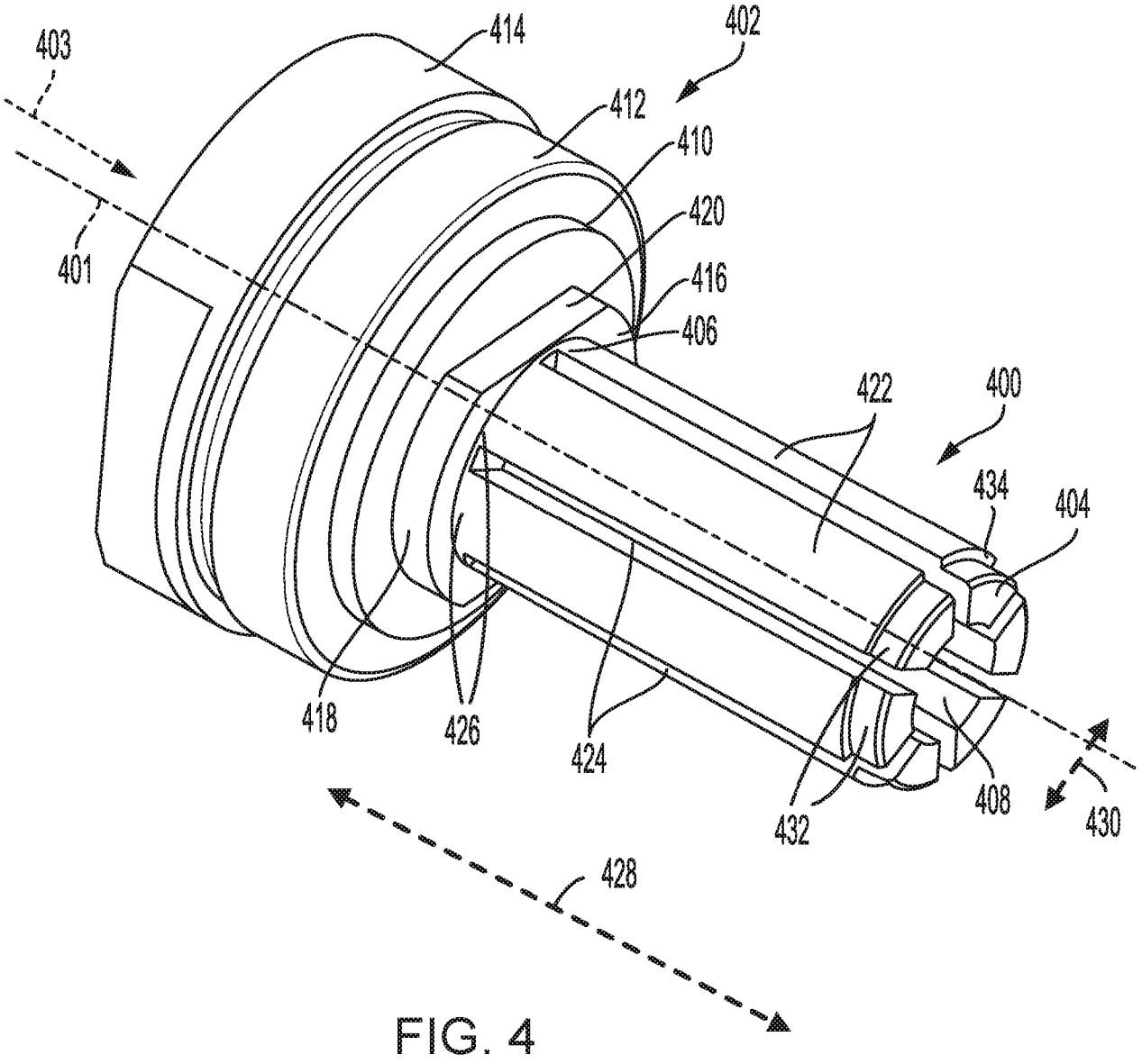
FIG. 4
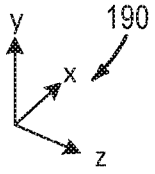

SELF-CLEANING FIREARMS SUPPRESSOR

CROSS REFERENCE TO RELATED APPLICATIONS

The present application claims priority to U.S. Provisional Application No. 62/628,568, entitled "Self-Cleaning Firearms Suppressor", and filed on Feb. 9, 2018. The entire contents of the above-listed application are hereby incorporated by reference for all purposes.

FIELD

The present description relates generally to methods and systems for a firearm suppressor.

BACKGROUND AND SUMMARY

Firearms may utilize high pressure exhaust gases to accelerate a projectile such as a bullet. Firearm silencers (hereafter referred to as "suppressors") may be added to the muzzle (exhaust) of a firearm to capture the high pressure exhaust gases of the firearm. These high pressure exhaust gases may be the product of burning nitrocellulose to accelerate the projectile. The typical exhaust gas pressure of a rifle cartridge in a full length barrel may be in the range of 7-10 Ksi while short barreled rifle may have exhaust gas pressures in the 10-20 Ksi range. Moving at supersonic speeds through the bore, the exhaust gases provide energy to launch the projectile but the rapid flow of the gases may also result in emanation of high-decibel noises during firearm discharge. When implemented, a firearm suppressor may lower a kinetic energy and pressure of the propellant gases and thereby reduce the decibel level of the resultant noises.

Firearms suppressors are mechanical pressure reduction devices that may comprise a center through hole to allow passage of the projectile. Suppressor design(s) utilize static geometry to induce pressure loss across the device by effects such as rapid expansion and contraction, minor losses related to inlet and outlet geometry, and induced pressure differential to divert linear flow.

Suppressors may function as "in-line" pressure reduction devices that capture and release the high pressure gases over a period of time. Typical suppressor design approaches used to optimize firearms noise reduction include maximizing internal volume, and providing a baffled or "tortured" pathway for propellant gas egress. Each of these approaches may be balanced against a desire for clear egress of the projectile, market demand for small overall suppressor size, adverse impacts on the firearms performance, adverse impacts on the operator, and constraints related to the firearms original mechanical design.

Particulate matter, including debris and burnt propellant residue, either formed during the firing of the projectile or accumulated environmentally such as lint or dust, may also follow the pathway of the projectile through the suppressor, being similarly propelled by high pressure gases. The energy of the gases, absorbed as heat by the baffle structures acting to restrain the flow of propellant gases, may also be absorbed by the inner walls of the suppressor housing. These heated surfaces in the path of the travelling particulate matter may provide surfaces to which the debris and residue may attach and adsorb.

The inventors herein have recognized significant issues, such as the lamination of particulate matter, related to the high energy propulsion of objects through the hot inner trajectory of the suppressor. The accumulation of particulate matter adhering to the inner surfaces of the suppressor may eventually degrade projectile movement through the suppressor. Efficient removal of suppressor parts arranged within an outer housing of the suppressor is desirable for thorough cleaning of the suppressor. Prior attempts to enable easy disassembly include, as shown by Worth and Person in U.S. Pat. No. 9,194,640, adapting a sleeve arranged inside the outer housing of the suppressor which envelops an elongate body of the inner core of the suppressor. The sleeve includes an opening, or slot, extending longitudinally along at least part of a length of the sleeve and may be straight or curved. A plurality of partial slots may also be arranged in the sleeve. In this way, the sleeve may be more flexible, e.g., more easily collapsed and thereby more easily removed from the suppressor outer housing for cleaning. After removal of the sleeve, the sleeve may be opened up slightly to promote the removal of suppressor parts from within the sleeve.

The inventors herein have identified some issues with the slotted sleeve housed within the firearms suppressor. The slot may, in some examples, be wide enough to allow particulate matter to pass through the sleeve and adhere onto the inner walls of the suppressor outer housing. This may lead to particulate matter accumulating between the sleeve and the outer housing as well as at the ends of the outer housing where the outer housing may be mated to an end cap at one end and a barrel end at the other end via threaded connections. Lamination of particulate matter to these threaded connections at the ends of the outer housing may hinder separation of the outer housing from the end cap or barrel end for disassembly of the suppressor. Furthermore, the slotted sleeve may not prevent the lamination of particulate matter from adhering to the outer housing due to a possible direct path of particulate matter to the outer housing and to surfaces of the inner core of the suppressor. Lamination of particulate matter to the surfaces of the inner core of the suppressor may result in reduced noise suppression and/or degradation of projectile flow through the suppressor. As an example, as the accumulation of particulate matter within the suppressor increases, the projectile may be deflected and cause a baffle strike, degrading the suppressor.

The inventors herein have recognized that the issues described above are at least partially solved by a firearms suppressor comprising an inner core and an outer housing. In one example, the inner core of the firearms suppressor may include a baffle system for noise suppression coupled at one end to a diffuser. The diffuser may have slots that extend longitudinally along the length of the diffuser toward an end of the firearms suppressor where a projectile may exit. This may allow release of pressure outwards through the slots as the projectile travels through the suppressor and also direct travelling particulate matter out of the diffuser through the said slots. The diffuser may be circumferentially surrounded by a blast chamber and inner surfaces of the blast chamber may provide heated surfaces to which particulate matter may laminate. A combination of the diffuser and blast chamber may mitigate accumulation of particulate matter within an inner passage of the firearms suppressor providing a path for projectile travel. The outer housing of the firearms suppressor may include an inner sleeve that is scrolled, disposed between the inner core and an outer tube of the firearms suppressor that may enable efficient disassembly of firearms suppressor for cleaning. Additionally, the flexibility of the inner sleeve may allow it to expand and retract to mute exhaust gas sounds emanating from the firearms suppressor.

In this way, the combined effects of the diffuser and blast chamber(s) may inhibit the accumulation of debris in the path of the projectile within the firearms suppressor by directing the particulate matter away from the projectile path to instead laminate to surfaces of the blast chamber(s). As such, the firearms suppressor may be configured to store more particulate matter before a cleaning operation is desired. Furthermore, the scrolled sleeve may protect the inner surface of the outer housing of the suppressor from adherence of particulate matter and may enable easy removal of particulate matter collected in the blast chamber(s).

It should be understood that the summary above is provided to introduce in simplified form, a selection of concepts that are further described in the detailed description. It is not meant to identify key or essential features of the subject matter. Furthermore, the disclosed subject matter is not limited to implementations that solve any disadvantages noted above or in any part of this disclosure.

BRIEF DESCRIPTION OF THE DRAWINGS

FIG. 4 shows an example of a diffuser of the firearms suppressor.

FIGS. 1-6 are shown approximately to scale.

DETAILED DESCRIPTION

Figure 1:
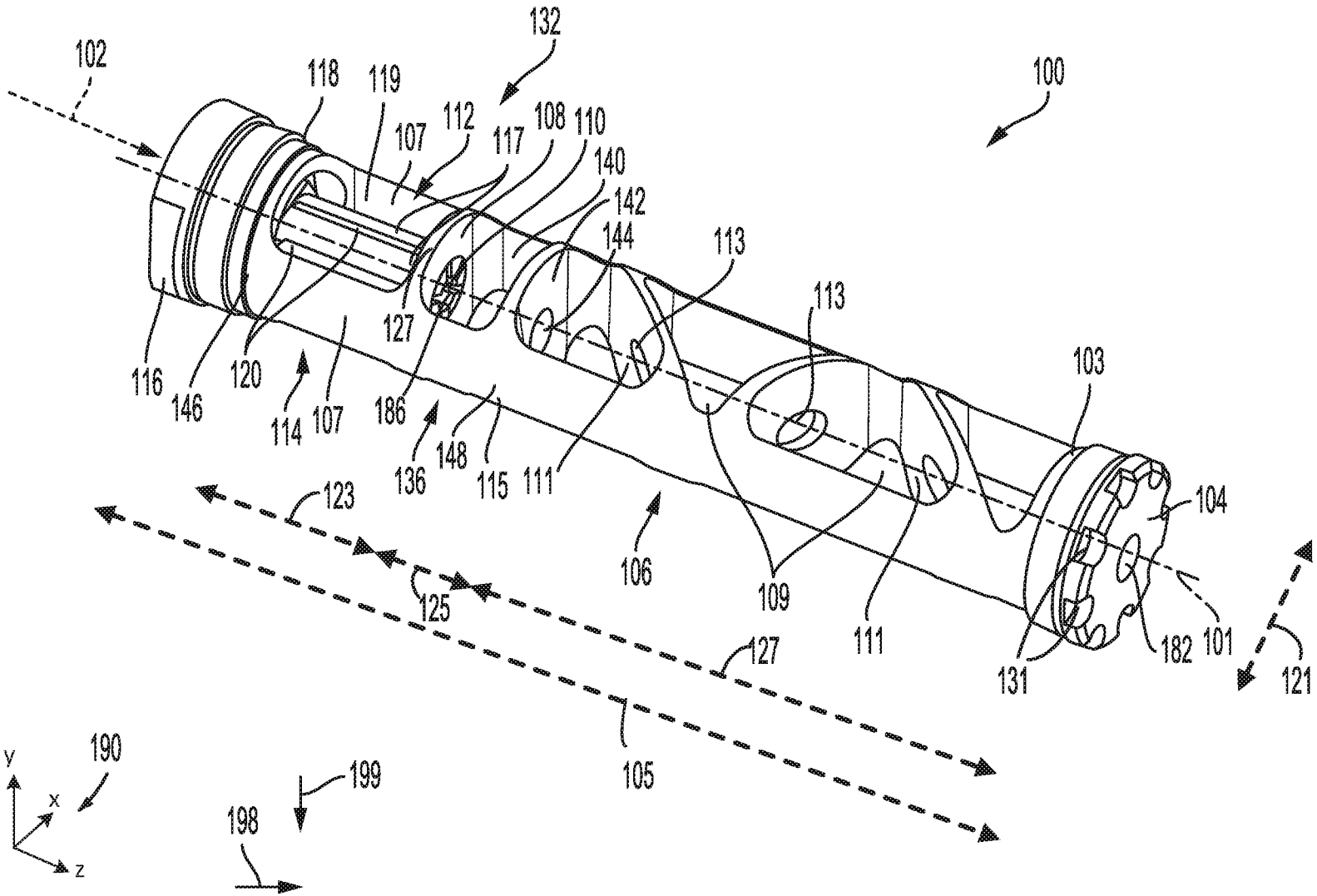
FIG. 1 shows a first example embodiment of a firearms suppressor, shown without an outer housing and scrolled sleeve.
Figure 2:
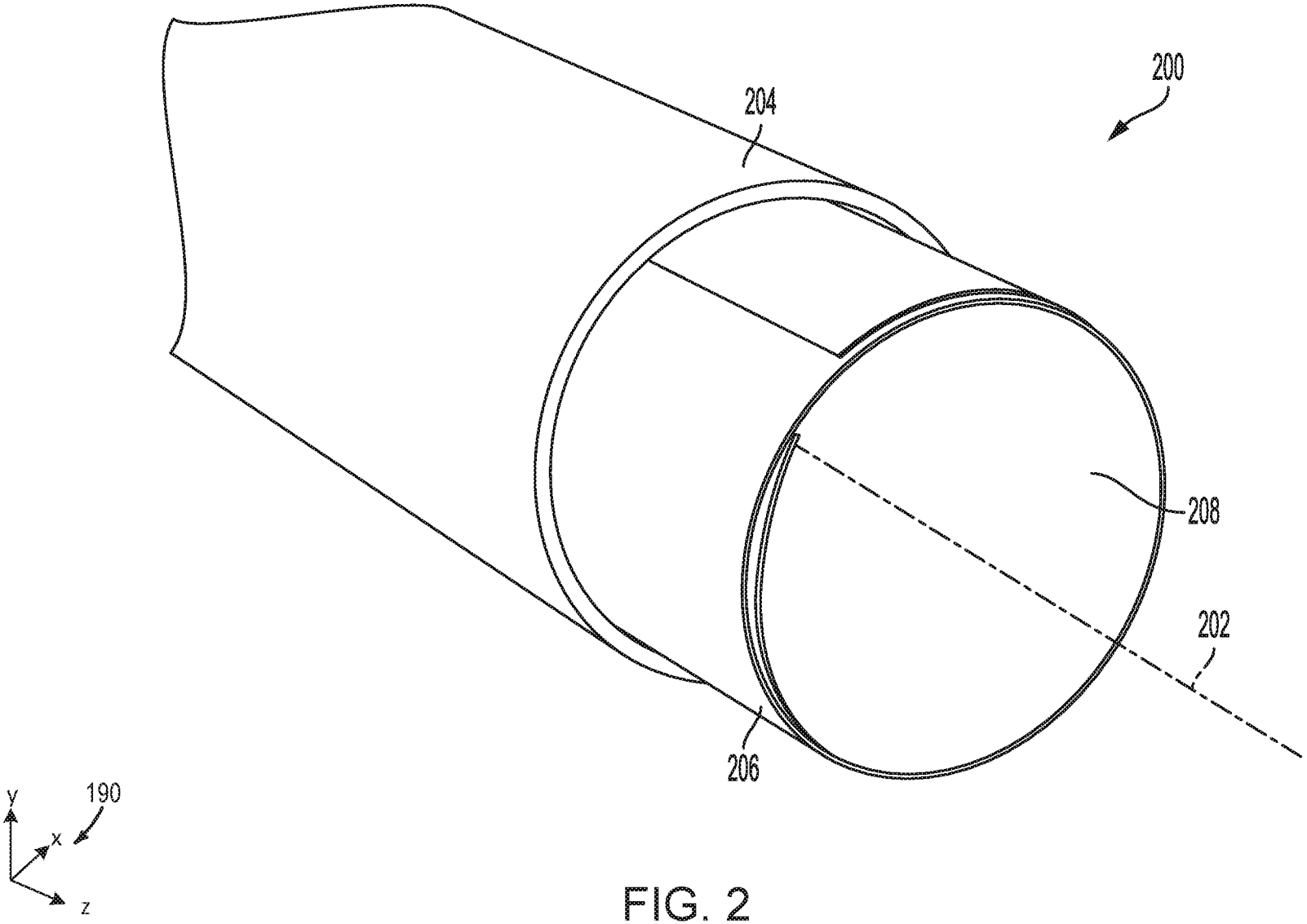
FIG. 2 depicts an outer housing and scrolled sleeve for a firearms suppressor.
Figure 5:
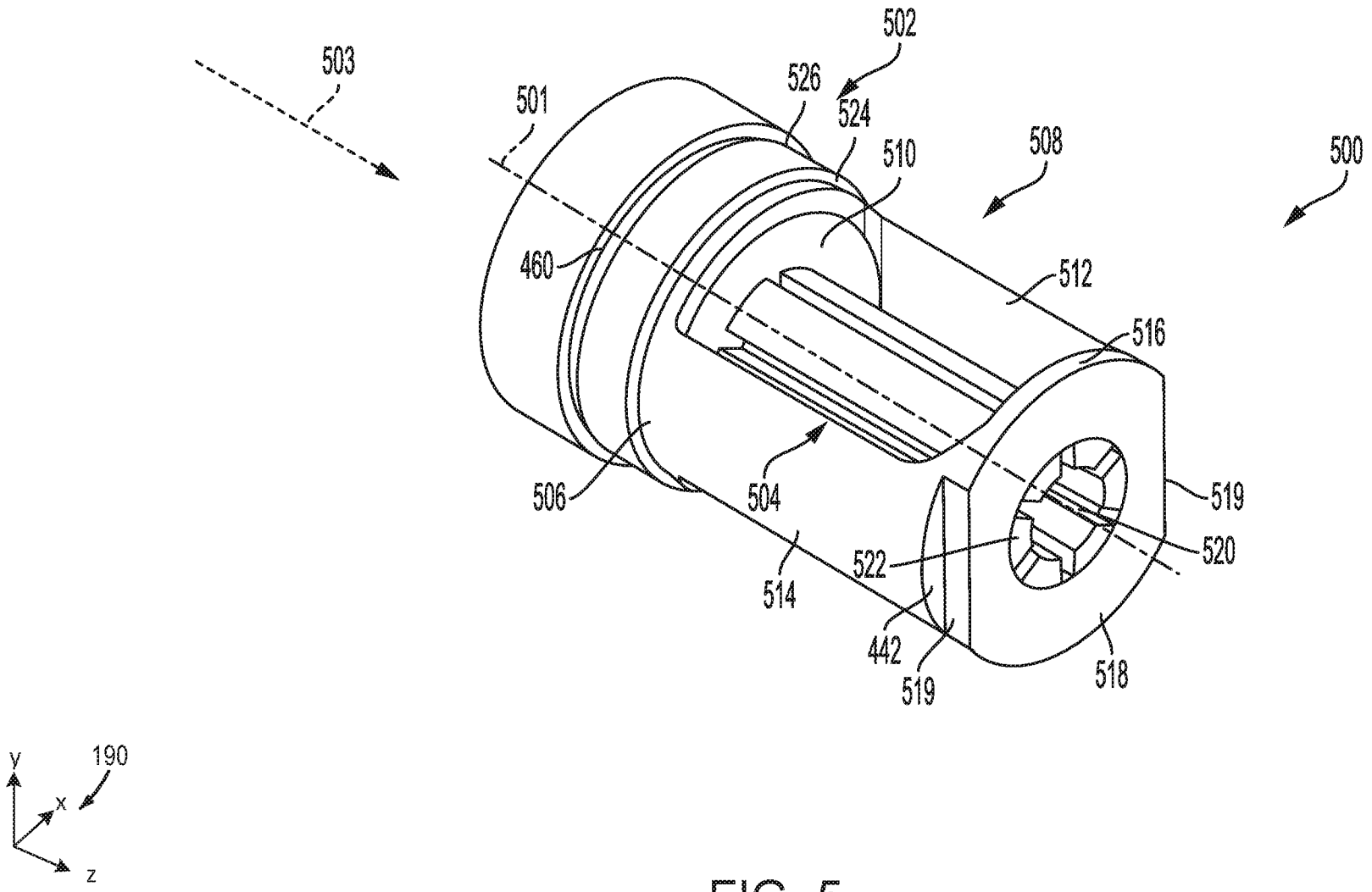
FIG. 5 shows an example of the diffuser enclosed by a single blast chamber system.
Figure 6:
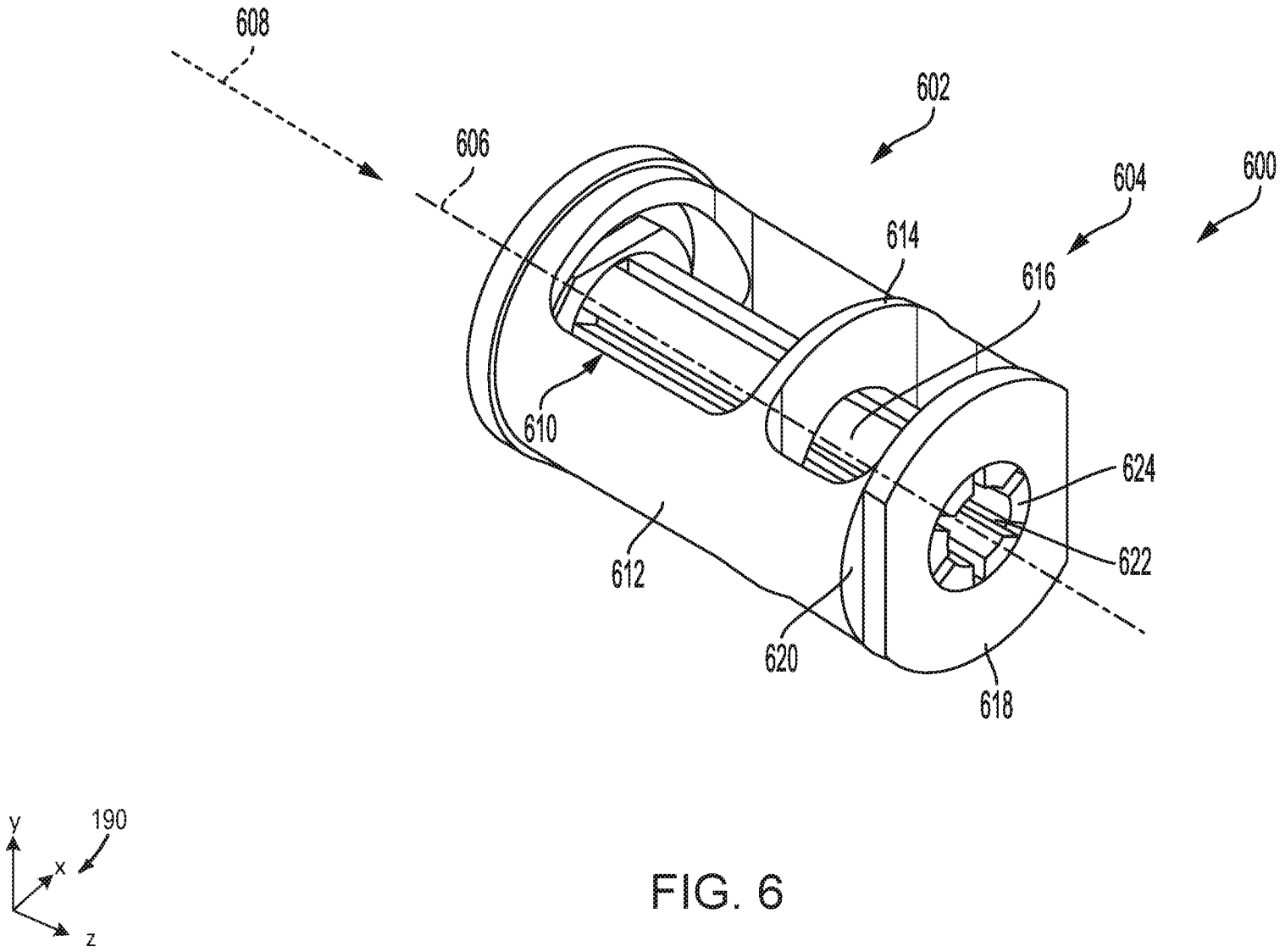
FIG. 6 shows an example of the diffuser enclosed by a dual blast chamber system with a variation in dimensions of the diffuser.
Figure 7:
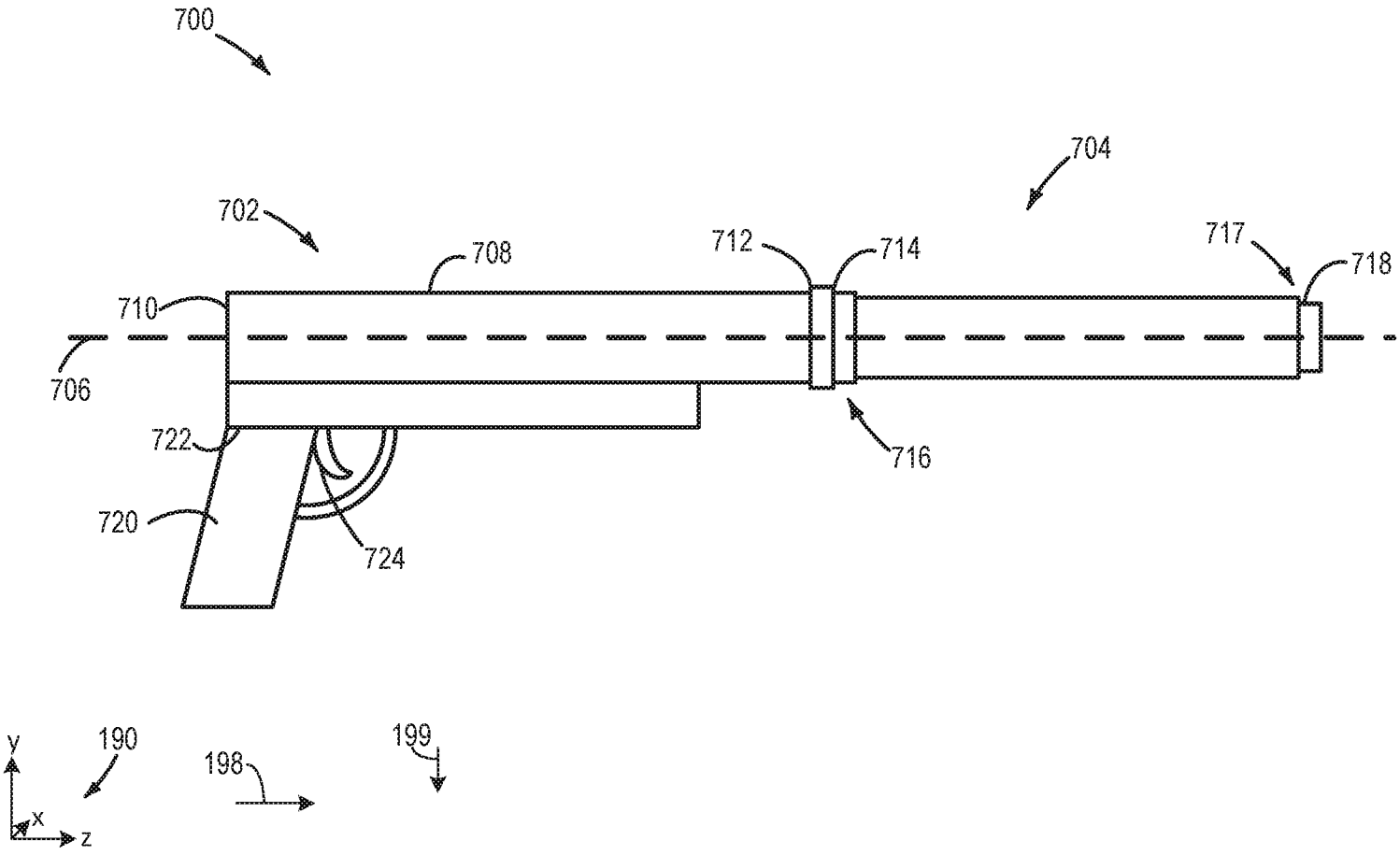
FIG. 7 shows a schematic of a firearms system including a firearm coupled to a firearms suppressor.

The following description relates to systems and methods for a firearms suppressor. Elements of the firearms suppressor that may be enclosed within an outer housing and scrolled sleeve are shown in FIG. 1, without the outer housing or scrolled sleeve, and includes an end cap, a monocore baffle system, a diffuser, and at least one blast chamber surrounding the diffuser. The outer housing surrounding the scrolled sleeve is shown in FIG. 2, depicting an arrangement of the scrolled sleeve within the outer housing as well as a coiled configuration of the scrolled sleeve. A blast chamber system with dual blast chambers that may surround the diffuser is depicted without the diffuser in FIG. 3. The diffuser is shown in greater detail in FIG. 4 without one or more blast chambers surrounding the diffuser. FIGS. 5-6 illustrate variations in configuration that may be implemented when the diffusor is combined with the blast chamber system. The blast chamber system may include one or two blast chambers and the diffusor may extend longitudinally within the blast chamber system to different lengths relative to a length of the blast chamber system. A coupling of the firearms suppressor to a firearm is depicted in FIG. 7 showing a positioning of the firearms suppressor relative to the firearm from which a projectile may be launched.

A firearms suppressor may function to dampen noise associated with a firing of a projectile from a firearm. As the projectile passes through the firearms suppressor, attached to a barrel of the firearm as shown in FIG. 7, components of the firearms suppressor may dampen noise and absorb heat produced during a high energy release of gases captured behind the projectile. When further adapted with the components depicted in the following figure descriptions, the firearms suppressor may additionally assist in trapping particulate matter, such as unwanted debris, bullet, primer, and powder residue, generated during firing, away from the projectile path. A large portion of the particulate debris may be comprised of primer and powder residue but may also include lead shavings from the bullet that are released upon firing. In this way, a number of times the firearms may be fired may be increased before aggregation of particulate matter compels cleaning of the firearms suppressor.

A firearms suppressor may be attached to a firearm to reduce noise generated during firing of the firearm. A coupling of a firearms suppressor to a firearm is illustrated in FIG. 7 by a firearms system 700 comprising a firearm 702 coupled at one end to a firearms suppressor 704. A central axis 706 of the firearm system 700 is included. A reference set of axes 190 is provided for comparison between views shown, comprising three axes, namely a longitudinal z-axis parallel to a horizontal direction 198, a y-axis parallel to a direction of gravity 199, and a lateral x-axis which is perpendicular to each of the y- and z-axes. Firearm 702 may include a first portion 708 aligned parallel to the central axis 706 where a projectile may be loaded at a first end 710 of the first portion 708. The projectile may follow a trajectory through a length of the first portion 708, along the central axis 706 to exit the first portion 708 of firearm 702 at a second end 712. The second end 712 of the first portion is coupled to a barrel end 714 arranged at a first end 716 of the firearms suppressor 704. The projectile may continuing travelling through the firearms suppressor 704 along the central axis 706 and exit the firearms system 700 via an end cap 718 at a second, downstream end 717 of the firearms suppressor 704.

A second portion 720 of firearm 702 may be mated at a first end 722 to the first end 710 of the first portion 708 of firearm 702. The second portion 720 may extend down, with respect to the y-axis, and away from the first portion 708 in a direction that is angled relative to the y-axis. The second portion 720 of firearm 702 may include a trigger mechanism 724, adapted to initiate the acceleration of the projectile through the first portion 708 of firearm 702 and the firearm suppressor 704 when pressure is applied to the trigger mechanism 724.

In this way, a firearm system 700 may be operated by supporting the second portion 720 of the firearm 702, e.g. gripping the second portion 720 of firearm 702 in the hand of a user, and applying pressure, e.g. pulling, the trigger mechanism 724. The projectile, originating at the first end 710 of the first portion 708 of firearm 702, is launched in a direction along the central axis 706. The noise associated with the release of the projectile may be suppressed as the projectile travels through the firearms suppressor 704, thereby exerting a muffling effect on the sonic blast generated by the velocity of the projectile. In one example, the firearm 702 may be a hand gun such as a pistol. In another example, firearm 702 may be a long gun such as a rifle of shotgun. In yet another example of the firearm system 700, firearm 702 may be an airgun. It will be appreciated by those of ordinary skill in the art that there may be more examples of the firearm described above without departing from the scope of the present disclosure.

Turning now to FIG. 1, an example embodiment of a firearms suppressor 100 is depicted with a central axis 101 arranged in a longitudinal direction along a length of the firearms suppressor 100. The firearms suppressor 100 may have a cylindrical body, where a length 105 of the cylindrical body, measured along a central axis 101, is greater than a diameter 121, measured in a direction perpendicular to the central axis 101, of the firearms suppressor 100. A cross-section of the firearms suppressor 100, taken in a direction perpendicular to the central axis 101, may be circular. The central axis 101 may be parallel to the longitudinal z-axis.

A projectile path through the firearms suppressor 100 is represented by an arrow 102 and indicates an initial entry point through an opening, or inlet in a barrel end cap 116 of the firearms suppressor 100. The firearms suppressor 100 may couple to a barrel of a firearm at the barrel end cap 116. Components of the firearms suppressor will be described approximately in order along the projectile path. As such, the positioning of elements will be defined with respect to the projectile path of the firearms suppressor 100. Thus, an element in the projectile path of a reference point may be referred to as being downstream of the reference point while an element before a reference point in the projectile path may be referred to as being upstream of the said reference point.

The projectile enters the firearms suppressor 100 through an aperture in the barrel end cap 116, arranged at a most upstream region of the firearms suppressor 100. A lip 118 may be formed by the barrel end cap 116 at an upstream end of the firearms suppressor 100 that indicates how far a scrolled sleeve, such as a scrolled sleeve 206 shown in FIG. 2 and described further below, may extend along the length 105 of the firearms suppressor 100.

The barrel end cap 116 may act as a cap to an upstream end of the firearms suppressor 100 and may be attached to a first blast chamber 114 and a diffuser 112, for example, via threading disposed in a surface of the barrel end cap 116. The barrel end cap 116 may have a circular cross-section, taken in a direction perpendicular to the central axis 101, and may vary in an outer diameter along a length of the barrel end cap 116, the length parallel with the central axis 101.

The diffuser 112 is coupled to and arranged downstream of the barrel end cap 116. The diffuser 112 is positioned internal of and entirely enclosed by the first blast chamber 114 which is also coupled to the barrel end cap 116. The diffuser 112 may be spaced away from inner surfaces of the first blast chamber 114 and may be a hollow cylindrical shell arranged parallel to and centered about the central axis 101. A length 123 of the diffuser 112 may be equal to a length of the first blast chamber 114.

A wall of the diffuser 112 may be divided into a plurality of wall sections 117 separated by a plurality of slots 120, with an inner passage 186 extending through an inner central chamber of the diffuser 112. The inner passage 186 may be surrounded by the plurality of wall sections 117 and the plurality of slots 120, the inner passage 186 centered about and parallel with the central axis 101. The plurality of wall sections 117 may each be identical in a thickness (measured perpendicular to the central axis 101), a width (measured around a circumference of the diffuser 112), and a length (measured along the central axis 101), and spaced evenly apart by the plurality of slots 120. Each slot of the plurality of slots 120 may be disposed between two wall sections of the plurality of wall sections 117, an arrangement of the plurality of wall sections 117 defining an overall shape of the diffuser 112. A number of the plurality of wall sections 117 included in the diffuser 112 may be more or less than that shown in FIG. 1 and the width and length of the plurality of slots 120 disposed in between the plurality of wall sections 117 may be adapted according to the number of the plurality of wall sections 117 to maintain a positioning of the diffuser 112 within the first blast chamber 114.

The plurality of slots 120 may extend radially outward from the inner passage 186 of the diffuser 112 through the thickness of the plurality of wall sections 117. In one example, as shown in FIG. 1, the plurality of slots 120 may extend along the full length 123 of the diffuser 112. In other examples, the plurality of slots 120 may extend along at least a portion of the length 123 of the diffuser 112, the extension being determined by the number of the plurality of slots 120, the number of the plurality of wall sections 117 and the thickness of the plurality of wall sections 117. A width, measured perpendicular to the central axis 101, and a length, measured along the central axis 101, of the plurality of slots 120 may be tuned to offset the buildup of pressure behind the projectile by acting as vents for gas release proximal to an outlet end of the firearms suppressor 100. Exhaust gases in the inner passage 186 may flow through the plurality of slots 120 and out of the diffuser 112 toward the first blast chamber 114, e.g., radiate outwards from the central axis 101. The width of the plurality of slots 120 may also be configured to allow particulate matter to readily pass through the plurality of slots 120 radially outwards into the surrounding blast chamber 114. Further details of the diffuser 112 are provided below with reference to FIG. 4.

The diffuser 112 may be circumferentially surrounded by the first blast chamber 114 and spaced away from the first blast chamber 114 so that the outer surfaces of the diffuser 112 do not contact inner surfaces of the first blast chamber 114. An upstream, first end 146 of the first blast chamber 114 may be coupled to the barrel end cap 116 and a downstream end of the blast chamber 114 may be coupled to a second blast chamber 136, both the first blast chamber 114 and the second blast chamber 136 surrounded by an outer shell 107. The first end 146 of the first blast chamber 114 is also the first, upstream end of the dual blast chamber system 114. The outer shell 107 may form a smooth, curved outer wall of the firearms suppressor 100. Together, the first blast chamber 114 and the second blast chamber 136 may form a dual blast chamber system 132.

The first blast chamber 114 may have a larger inner volume than the second blast chamber 136 due to the longer length 123 of the first blast chamber 114 compared to a length 125 of the second blast chamber 136. A dividing wall 108 separates the inner volume of the first blast chamber 114 from the inner volume of the second blast chamber 136. The length 123 of the diffuser (also the length 123 of the first blast chamber 114) may terminate, at a downstream end, at the dividing wall 108. The dividing wall 108 may have a curved edge 127 that matches the outer, cylindrical geometry of the firearms suppressor 100.

The second blast chamber 136 may be a hollow, empty chamber positioned directly downstream of the first blast chamber 114. The outer shell 107 extends continuously across the lengths 123 and 125 of both the first and second blast chambers 114, 136, which are separated by the dividing wall 108. The dividing wall 108 may have a circular port 110, extending entirely through a thickness of the dividing wall 108, the thickness defined along the central axis 101. The port 110 in the dividing wall 108 may circumferentially surround a downstream end of the diffuser 112, adapted with a diameter equivalent to an outer diameter of the diffuser 112.

The dual blast chamber system 132 may be adapted with a plurality of openings in the outer shell 107. For example, the first blast chamber 114 may include a first set of cut-out openings 119 and the second blast chamber 136 may include a second set of cut-out openings 140. The first set of cut-out openings 119 may include two openings, disposed on opposite sides of the first blast chamber 114 in the outer shell 107. Similarly, the second blast chamber 136 may include two oppositely arranged openings in the second set of cut-out openings 140, as shown in FIG. 1, or a single opening. The first and second sets of cut-out openings 119, 140 may be shaped as rectangles with rounded corners. However, other geometries are possible. As well, other examples may comprise a single opening or more than two openings or openings of different shapes, sizes, and positioning in the outer shell 107 surrounding the dual blast chamber system 132.

The first set of cut-out openings 119 and the second set of cut-out openings 140 may be rectangular in shape and wider than each slot of the plurality of slots 120 of the diffuser 112. The first and second sets of cut-out openings 119, 140 may extend along a full or partial length of each of the first blast chamber 114 and second blast chamber 136, along the z-axis and a width along a circumference of the outer shell 107 that may be up to half of the circumference of the outer shell 107.

An end wall 142 may be positioned at the second end 148 of the second blast chamber 136. The end wall 142 may be similarly configured as the dividing wall 108 but the end wall 142 may have an aperture 144, centered about the central axis 101 along the projectile path, which may be smaller in diameter than the port 110 of the dividing wall 108. The end wall 142 may be an end wall of the dual blast chamber system 132 as well as an end wall of the second blast chamber 136.

A second end 148, downstream of the first end 146, of the dual blast chamber system 132 is coupled to a first end 115 of a monocore baffle system 106. The monocore baffle system 106 is arranged on an opposite side of the end wall 142 from the dual blast chamber system 132. The first end 115 may be coupled to the second end 148 of the dual blast chamber system 132 by a continuous extension of the outer shell 107 along a length 127 of the monocore baffle system, the outer shell 107 forming two uninterrupted oppositely arranged panels along the length 105 of the firearms suppressor 100.

The monocore baffle system 106 may include components such as baffle chambers 109 separated by baffle walls 111. The baffle walls 111 may extend diagonally across the two panels of the outer shell 107. A tilting of the baffle walls 111, with respect to the central axis 101 may alternate between a first angle and a second angle along the length 105 of the firearms suppressor 100. The baffle walls 111 may also include apertures 113, similar in diameter to the aperture 144 of the end wall 142, the apertures 113 aligned along the central axis 101 and providing a trajectory for the projectile to travel through the firearms suppressor 100. Details of the monocore baffle system are described further below with reference to FIG. 3.

A second end 103, opposite and downstream of the first end 115, of the monocore baffle system 106 may be coupled to an end cap 104. The end cap 104 may be a containment wall at a downstream end of the firearms suppressor 100. An aperture 182 may be centrally arranged in the end cap 104, configured as an outlet 182 of the firearms suppressor 100, allowing the projectile to exit the firearms suppressor 100 without impinging the velocity or trajectory of the projectile. As shown by arrow 102, the projectile may traverse an entire length of the firearms suppressor 100, entering the firearms suppressor via the inlet of the barrel end cap 116 and exiting via aperture 182 of the end cap 104. In this way, the firearms suppressor 100 may include a passage and/or series of apertures arranged along the central axis 101 for the projectile to pass through uninterruptedly downstream of the inlet.

The end cap 104 may further include a plurality of notches 131 arranged around a periphery of the end cap 104 along a downstream surface of the end cap 104. As one example, the end cap may be attached to the second end 103 of the monocore baffle system 106 by a first set of threading disposed in an outer surface of the monocore baffle system at the second end 103 and a second set of threading configured to mate with the first set of threading disposed in an inner surface of the end cap 104. Thus, the end cap 104 may be coupled to the monocore baffle system 106 by twisting the end cap 104 while in contact with the second end 103 of the monocore baffler system 106. The plurality of notches 131 may thereby provide an operator with a more secure grip on the end cap 104. In one example, the end cap 104 may have male threading that couples to female threading in an outer tube of the firearms suppressor 100, such as an outer tube 204 of FIG. 2. In other examples, the end cap 104 may have female threading that couples to male threading in the outer tube of the firearms suppressor 100 or the end cap 104 may coupled to the outer tube via some other method or system for coupling, such as a pressure fitting, a pin and sleeve connection, etc.

As an example, the firearm coupled to the firearms suppressor 100 may be actuated and the projectile may be propelled therefrom. The projectile may pass through the inlet in the barrel end cap 116 of the firearms suppressor 100 and enter the diffuser 112. Debris, bullet residue, primer residue, and powder residue (e.g., particulate matter), generated during explosive release of the projectile, may accompany exhaust gases, also formed during discharge of the projectile, and travel through the firearms suppressors 100 along the projectile path through the diffuser 112. The projectile traverses the inner passage 186 of the diffuser 112 while exhaust gases and particulate matter may exit the inner passage 186 and flow through the plurality of slots 120 of the diffuser 112 toward the inner surfaces of the surrounding first blast chamber 114.

In one example, the exhaust gases and particulate matter may flow in a radially outward direction, perpendicular to the projectile, to the first blast chamber 114. Particulate matter, exiting the diffuser 112 may contact the heated inner surface of the first blast chamber 114 and adhere, halting the course of particulate matter travel in the firearms suppressor 100. Some of the particulate matter may have sufficient momentum to escape lamination within the first blast chamber 114. At least a portion of the escaped particulate matter may pass through the port 110 in the dividing wall 108 of the dual blast chamber system 132 and continue into the second blast chamber 136. Upon reaching the second blast chamber 136, the particulate matter may lose velocity and momentum, increasing a likelihood of lamination to heated inner surfaces of the second blast chamber 136.

Additionally or alternatively, at least a portion of the escaped particulate matter may pass through the first set of cut-out openings 119 in the outer shell 107 surrounding the first blast chamber 114 or through the second set of cut-out openings 140 surrounding the second blast chamber 136. The escaped particulate matter may subsequently collide with a scrolled sleeve, such as a scrolled sleeve 206 shown in FIG. 2 surrounding the dual blast chamber system 132 and monocore baffle system 106, and collect in a space between the scrolled sleeve and dual blast chamber system 132.

Exhaust gases may also flow out of the dual blast chamber system 132 to the scrolled sleeve via the first and second sets of cut-out openings 119 and 140, and undergo further cooling and slowing. The projectile may then pass through the monocore baffle system 106 through each of the apertures 113 of the baffle walls 111. In the monocore baffle system 106, exhaust gases produced as a byproduct of a projectile propulsion reaction may deviate from the central axis 101 in the monocore baffle system and flow in radially outward directions guided by the baffle walls 111. As the exhaust gases pass through the monocore baffle system 106, heat from the gases may be transferred to the baffle walls 111, thereby cooling and reducing the velocity of the gases.

The exhaust gases may flow toward the scrolled sleeve and at least a portion of the dual blast chamber system 132. The projectile, however, may remain aligned with the central axis 101 and exit the firearms suppressor 100, along with some exhaust gases, via the outlet 182 arranged in the end cap 104. In one example, the inlet of the barrel end cap 116, arranged on a geometric center of the barrel end cap 116, is substantially identical to the outlet 182.

In this way a diffuser, enclosed by a blast chamber system, imparts a firearms suppressor with a self-cleaning function by trapping particulate matter which may otherwise, after a number of firings, impede projectile passage through the firearms suppressor. The particulate matter may be directed away from a central passage along with high velocity, hot exhaust gases, through slots in the diffuser and become affixed to hot inner surfaces of the blast chamber system. An arrangement of a scrolled sleeve around the blast chamber further traps particulate matter and also enables easy cleaning and maintenance of the firearms suppressor. The scrolled sleeve may be a component of an outer assembly of the firearms suppressor, along with an outer housing. The outer assembly is shown in FIG. 2.

FIG. 2 shows an outer assembly 200 of a firearms suppressor, such as the firearms suppressor 100 in FIG. 1, with a central axis 202 running longitudinally through the outer assembly 200. The outer assembly 200 includes an outer tube 204 surrounding a removable scrolled sleeve 206 and both the outer tube 204 and scrolled sleeve 206 may be adapted to have inner diameters of appropriate width to circumferentially surround and enclose a monocore baffle system and blast chamber coupled with a diffuser, with reference to components of the firearms suppressor 100 of FIG. 1.

The outer tube 204 may be a long, hollow cylinder with a uniform diameter along an entire length of the outer tube 204. The outer tube 204 may be formed from a heat-resistant, rigid material, such steel, stainless, steel, titanium, ceramic, aluminum as well as plastics and composites with higher heat resistivity and strength.

The scrolled sleeve 206, may be an elongate hollow cylinder with a coiled circular cross-section, taken in a direction perpendicular to the central axis 202. The scrolled sleeve 206 may resemble a flexible tube, where the tube is flexible in a radial direction towards and away from the central axis 202 so that a diameter of the tube may be slightly contracted or slightly expanded. Unlike the outer tube 204, a material of the scrolled sleeve 206 may not be continuous, being instead a rolled sheet of material. An inner passage 208 of the scrolled sleeve 206 is wide enough in diameter to accommodate insertion of a monocore baffle system, such as monocore baffle system 106 of FIG. 1 and a dual blast chamber system, such as the dual blast chamber system 132 of FIG. 1. An outer diameter of the scrolled sleeve 206 may be slightly smaller than the inner diameter of the outer tube 204, and a length of the scrolled sleeve 206 may be equal to or less than a length of the outer tube 204.

The scrolled sleeve 206 may be formed from a bendable sheet of a heat-resistant material such as steel, stainless steel, titanium, high-temperature plastic film, or a high-temperature flexible composite, with a thickness that is less than the thickness of the outer tube 204. The sheet from which the scrolled sleeve 206 may be formed may be of a width, defined in a direction perpendicular to the central axis 202 that allows the material to wrap around itself more than once when scrolled (e.g., rolled up so that the scrolled sleeve 206 may slide into the outer tube 204). For example, the scrolled sleeve 206 may wrap around itself 1.5 times, relative to a circumference of the scrolled sleeve 206.

In other examples, the scrolled sleeve 206 may wrap around itself 2 times or 3 times around the circumference of the scrolled sleeve 206. By wrapping around itself more than once around the circumference of the scrolled sleeve 206, debris is inhibited from reaching the outer tube 204. Increasing the number of times the scrolled sleeve 206 wraps around itself may provide better blockage of debris but may also add weight to the scrolled sleeve. Furthermore the number of times the scrolled sleeve 206 wraps around itself more than once may be determined by an amount of space available between the outer housing 204 and inner components of the firearms suppressor to accommodate a thickness of the scrolled sleeve 206.

The scrolled sleeve 206 may, in one example, extend along a full length, along the central axis 202, of the firearms suppressor to reach a barrel end cap, such as the barrel end cap 116 in FIG. 1. In another example, the scrolled sleeve 206 may extend along 75% of the length of the firearms suppressor, with at least a portion of the dual blast chamber system uncovered by the scrolled sleeve 206. In yet another example, the scrolled sleeve 206 may extend along 50% of the length of the firearms suppressor. As such, it may be appreciated that the function of the firearms suppressor described herein should not be limited by the extension of the scrolled sleeve 206 along the length of the firearms suppressor.

The scrolled sleeve 206 may be adapted to slide easily in and out of the outer tube 204 as a result of the flexibility provided by the scrolled arrangement of scrolled sleeve 206. Specifically, the diameter of the scrolled sleeve may be adjustable by applying pressure to the outside of the scrolled sleeve in an inwards direction, e.g., squeezing. The flexibility of the scrolled sleeve 206 may also assist in the release of particulate matter during cleaning, e.g., small expansions and small contractions in the diameter may agitate and loosen adhered particulate matter or, alternatively, the scrolled sleeve may be treated with solvents, mild acids and cleaning instruments for particulate matter that is more difficult to remove. Furthermore, a positioning of the scrolled sleeve 206 against an outer surface(s) of the blast chamber(s) may inhibit particulate matter from reaching an inner surface of the outer tube 204.

A position of the scrolled sleeve 206 between the barrel end cap and the end cap of the firearms suppressor, and within the outer tube 204, may be maintained by a fastening of the barrel end cap to an inlet end of the firearms suppressor. In one example, the barrel end cap may be adapted with threading to couple to an end of the outer tube 204. In another example, the barrel end cap may be coupled to an upstream end of the dual blast chamber system by a pressure-based fitting. In further examples, the barrel end cap may be attached by some other type of fitting that may allow for the secure mating of the barrel end cap to an end of the outer tube 204. The role of the scrolled sleeve 206 may include blocking particulate matter from adhering to a region where the outer tube 204 threads onto the barrel end cap. By setting the scrolled sleeve 206 adjacent to the outer surfaces of the blast chamber(s), use of an o-ring, which may be prone to thermal degradation, to seal the connection between the outer tube 204 and the barrel end cap may be circumvented.

Figure 3:
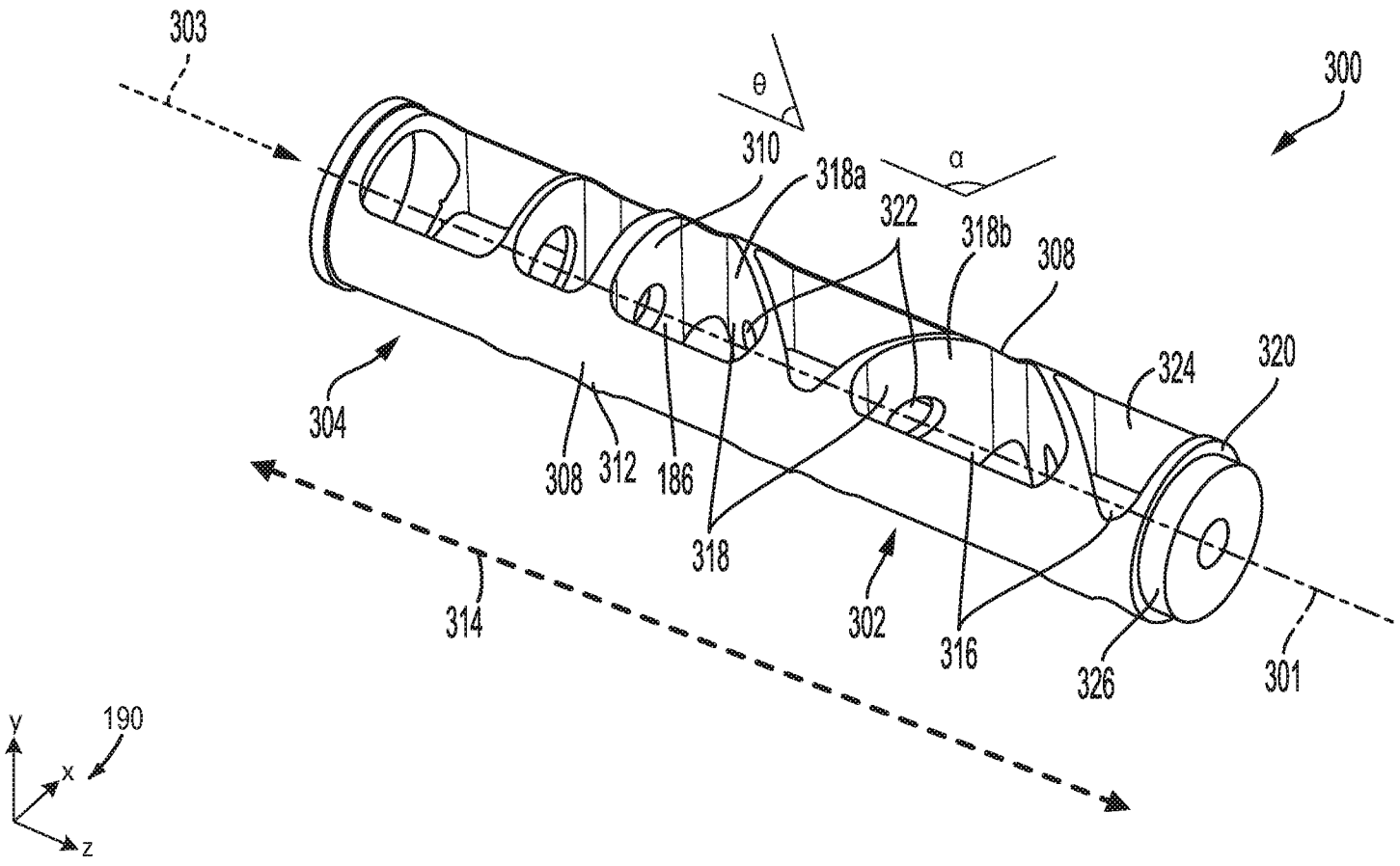
FIG. 3 shows a second example embodiment of a firearms suppressor.

As described above, a scrolled sleeve may surround components of a firearms suppressor, including a monocore baffle system. An example of a firearms suppressor 300 is shown in FIG. 3, without a diffuser, a barrel end cap at an upstream end or an end cap at a downstream end. The firearms suppressor 300 has a central axis 301. A monocore baffle system 302 is depicted in the firearms suppressor 300 unremovably, fixedly and continuously coupled to a dual blast chamber system 304 and positioned downstream of the dual blast chamber system 304. In some examples, the monocore baffle system 302 and the dual blast chamber system 304 may be the monocore baffle system 106 and dual blast chamber system 132 of FIG. 1. A direction of projectile travel is indicated by arrow 303.

As described above, a first end 308 of the monocore baffle system 302 may couple to an end wall 310 of the dual blast chamber system 304, the monocore baffle system 302 continuing downstream of the dual blast chamber system 304 without interrupting an outer curved surface of an outer shell 312 of the firearms suppressor 300, the outer shell 312 extending along oppositely facing sides of the firearms suppressor 300 as two panels that span an entire length 314 of the firearms suppressor 300. In other examples, the outer shell 312 may form more or less than two panels along the length 314 of the firearms suppressor 300.

The monocore baffle system 302 may have an elongate, generally cylindrical geometry configured with a number of hollow chambers arranged along a length of the monocore baffle system 302, dividing an inner volume of the monocore baffle system 302 into segments. The monocore baffle system 302 is positioned downstream of the dual blast chamber system 304 to assist in decelerating and cooling gases that accompany a projectile travelling through the firearms suppressor 300. Specifically, the monocore baffle system 302 comprises structures with geometries that may be optimized for noise suppression and heat transfer. Hollow chambers 316 (herein, baffle chambers 316), are disposed within the monocore baffle system 302 which are divided by baffle walls 318 that may be angled in opposite directions relative to one another.

For example, the baffle walls 318 alternate in orientation such that a first set of baffle walls 318*a* that includes every other baffle wall is oriented substantially identical and at a first angle relative to the central axis 301 while a second set of baffle walls 318*b* may be oriented at an oppositely tilted second angle relative to the central axis 301. Each baffle wall of the second set of baffle walls 318*b* may be arranged in between the first set of baffle walls 318*a* so that the baffle walls 318 includes an alternating pattern of a baffle wall from the first set of baffle walls 318*a* followed by a baffle wall from the second set of baffle walls 318*b*, along the central axis 301 from the first end 308 of the monocore baffle system 302 to a second, downstream end 320 of the monocore baffle system 302.

In a non-limiting example, the first set of baffle walls 318*a* may be angled at an angle that is 60 degrees with respect to the central axis 301. The second set of baffle walls 318*b* may be angled at an angle $\alpha$ that is 120 degrees relative to the central axis 301. In other examples, the angle $\alpha$ formed between the first set of baffle walls 318*a* and the central axis 301 may be any angle between 30-90 degrees and the angle $\alpha$ of the second set of baffle walls 318*b* relative to the central axis may be any angle between 90 and 150 degrees. By alternating an orientation of the baffle walls 318, exhaust gas flow may be more greatly interrupted and an acoustic environment of the monocore baffle system 302 may destruct sounds emanating therefrom more efficiently than other monocore baffle system 302 arrangements.

The baffle chambers 316 may be openings arranged between each of the baffle walls 318 as well as between inner surfaces 324 of the outer shell 312, arranged approximately perpendicular to the baffle walls 318, of the monocore baffle system 302. A shape of the baffle chambers 316 follows an orientation of the baffle walls 318. In one example, the baffle chambers 316 comprise a trapezoid shape. However, if the baffle walls 318 are oriented in a direction perpendicular to the central axis 301, then the baffle chambers 316 may comprise a square or rectangular shape.

The baffle chambers 316 may be configured to allow exhaust gases to flow therethrough in radially outward directions away from the central axis 301. Apertures 322 are centrally disposed in each of the baffle walls 318 and are aligned so that the projectile may pass unhindered through each of the baffle chambers 316 and the baffle walls 318 along the central axis 301. As such, despite alternating orientations of adjacent baffle walls and the apertures 322 following an angle of the baffle walls 318, the apertures 322 may still readily allow the projectile to pass therethrough. As shown, a baffle wall of the baffle walls 318 and its corresponding aperture of the apertures 322 are concentric about the central axis 301. In this way, the aperture of the baffle wall may be located on a geometric center of the baffle wall.

The baffle walls 318 may be physically coupled to one or more inner surfaces 324 of the outer shell 312 of the monocore baffle system 302 that may be coaxial with the central axis 301. The inner surfaces 324 may comprise two surfaces arranged apart from one another in the example of FIG. 3. In one example, the inner surfaces 324 are exactly opposite one another (e.g., 180 degrees apart). Additionally or alternatively, the surfaces 324 may be less than or greater than 180 degrees apart. It will be appreciated by those of ordinary skill in the art that there may be more than two of the inner surfaces 324 without departing from the scope of the present disclosure. For example, there may be three inner surfaces 324 arranged 60 degrees apart from one another. Alternatively, the three surfaces may be asymmetric such that one of the surfaces is biased toward (e.g., closer to) another one of the three inner surfaces 324. Furthermore, the two or more inner surfaces 324 may extend along a length of the dual blast chamber system 304 and form inner surfaces of an outer shell of the dual blast chamber system 304 so that the inner surfaces 324 are continuous across the entire length 314 of the firearms suppressor 300. In other words, the more than two inner surfaces 324 of the outer shell 312 of the monocore baffle system 302 may also include the inner surfaces of the dual blast chamber system 304.

The inner surfaces 324 terminate at the second end 320 of the monocore baffle system 302 that may be arranged at an extreme end of the monocore baffle system 302 opposite the first end 308. As shown, a length of the monocore baffle system 302, defined along the central axis 301, is greater than a length of the dual blast chamber system 304. However, it will be appreciated, in other examples, that the lengths may be equal or the dual blast chamber system 304 may be longer than the monocore baffle system 302 without departing from the scope of the present disclosure.

The second end 320 of the monocore baffle system 302 may include a terminal section 326 that is reduced in diameter to accommodate coupling to an end cap, such as the end cap 104 of FIG. 1. As shown in FIG. 3, the terminal section 326 may have smooth surfaces parallel with the central axis 301 to allow the end cap to be pressed on and maintained in place by friction and pressure exerted on the terminal section 326 by the end cap. In other examples, the surfaces of the terminal section 326 may be threaded to mate with threading on the end cap, as described above.

The monocore baffle system 302 may be formed from a same material as the dual blast chamber system 304 and a diffuser, which may be a heat-resistant material such as steel, stainless steel, titanium, ceramic, iron, or aluminum. Alternatively, the monocore baffle system 302 may be formed from other highly heat resistant and robust materials such as plastics or composites.

A monocore baffle system of a firearms suppressor may be configured to absorb heat and divert exhaust gases away from a projectile trajectory through the firearms suppressor. Absorption of heat at baffle walls of the monocore baffle system however, may provide surfaces sufficiently hot to encourage undesirable lamination of particulate matter, the particulate matter released during discharge of the projectile, By adapting the firearms suppressor with a diffuser, particulate matter may be captured within a portion of the firearms suppressor, upstream of the monocore baffle system, thereby reducing a likelihood that the particulate matter contacts the baffle walls of the monocore baffle system. A diffuser 400 is illustrated in FIG. 4 coupled to a barrel end cap 402 which may be used similarly as the diffuser 112 and the barrel end cap of FIG. 1. The diffuser 400 has a central axis 401 and a direction of projectile travel through the diffuser 400 is indicated by arrow 403.

The diffuser 400 may be arranged in a firearms suppressor so that a second, downstream end 404 is coupled to a wall of a blast chamber system, such as the dividing wall 108 of FIG. 1, and a first end 406 is coupled to the barrel end cap 402, similar to the arrangement depicted in FIG. 1. The diffuser 400 may be attached to the barrel end cap 402 by welding, by threading the diffuser 400 into the barrel end cap 402 or by bolts. With reference to the dual blast chamber system 132 of FIG. 1, the diffuser 400 may be enclosed within a blast chamber, with the diffuser 400 having a smaller outer diameter than an inner diameter of the blast chamber. The diffuser 400 may include an inner passage 408 through which a projectile may travel.

The barrel end cap 402 may include a first section 410, a second section 412, and a third section 414, that have sequentially larger outer diameters along a direction opposite of the direction of the projectile path, the diameters perpendicular to the central axis 401. In other words, an outer diameter of the second section 412 may be larger than an outer diameter of the first section 410 and an outer diameter of the third section 414 may be larger than the outer diameters of both first and second sections 410 and 412. In one example, a curved outer surface of the second section 412 may be adapted with threading that allows the barrel end cap 402 to be attached to a threaded end of an outer tube, such as the outer tube 204 of FIG. 2. However, the outer surface of the second section 412 may alternatively be smooth and secured to the outer tube by pressure and friction.

An aperture, which may be an inlet of the firearms suppressor, may extend through an entire length of the barrel end cap 402, the aperture aligned with the inner passage 408 of the diffuser 400. Each of the first, second, and third sections 410, 412, and 414 of the barrel end cap 402 may have a circular cross-section, taken along the y-x plane. The barrel end cap 402 may be adjacent to and upstream of the diffuser 400 and may be in face-sharing contact with a plate 416 of the diffuser 400 at the first end 406.

The plate 416 may have a set of curved sides 418 and a set of straight sides 420. The set of straight sides 420 may be wrench flats that allow a tightening and loosening of the diffuser 400 to the barrel end cap 402. In other examples, the plate 416 may have different configurations in place of the set of straight sides 420 that allows the set of straight sides 420 to mate with other tools to fasten the diffuser 400 to the barrel end cap 402, such as notches for a spanner wrench or a hexagonal shape for a socket or socket end wrench. The diffuser 400 may be configured with a threaded fitting at the first end 406, extending upstream of the plate 210 along the central axis 401 and adapted to mate with threading disposed in an inner surface of the barrel end cap 402. In another example, the diffuser 400 may be integrated with or part of (e.g. one piece) the barrel end cap 402. The projectile, entering the barrel end cap 402 through the inlet, may travel through the barrel end cap 402 and enter the inner passage 408 of the diffuser 400.

The inner passage 408 of the diffuser 400 may be surrounded by a plurality of wall sections 422 comprising a plurality of slots 424. Upstream ends 426 of the plurality of wall sections 422 may be attached to or formed from a single unit that includes the plate 416. The plurality of slots 424 may be arranged parallel to the central axis 401 and the projectile path as indicated by the arrow 403. The plurality of slots 424 may extend radially outward between the plurality of wall sections 422 of the diffuser 400, e.g. through a thickness of the plurality of wall sections 422, allowing high velocity gases and accompanying particulate matter to pass through the plurality of slots 424 and exit the inner passage 408 of the diffuser 400 in an outwards direction perpendicular to the central axis 401. The plurality of slots 424 may extend longitudinally along a length 428 of the diffuser 400 but may alternatively extend along a portion of the length 428 of the diffuser 400 that is less than the full length 428. For example, the plurality of slots 424 may extend 30%, 50%, or 70% of the length 428 of the diffuser 400 and a width 430 of the plurality of slots 424 may vary in conjunction with changes in the length 428. As an example, if the plurality of slots 424 extend 50% of the length 428 of the diffuser 400 instead of the full length 428, the width 430 of the plurality of slots 424 may be twice as wide. Also, the plurality of slots 424 and the plurality of wall sections 422 of FIG. 4 are all of equal widths and equal lengths but in other examples, the plurality of slots 424 and plurality of wall sections 422 may be of different widths and different lengths from one another, e.g., one slot may be wider than another slot, one wall section may be shorter than another wall section etc. Furthermore, the number of the plurality of slots 424 may vary according to the widths of the slots or the widths of the plurality of wall sections 422. The widths of the plurality of slots 424 may also increase or decrease along the length of the diffuser 400 or vary in width along the length so that the widths are not uniform. As such, variations in dimensions and numbers of the plurality of slots 424 and plurality of wall sections 422 should not limit the scope of the present disclosure.

At downstream ends 432 of the plurality of wall sections 422, the plurality of wall sections may be adapted with a shoulder 434 such that a diameter of the diffuser 400 downstream of the shoulder 434 is smaller than a diameter of the diffuser 400 upstream of the shoulder 434, the diameter measured perpendicular to the central axis 401. The shoulder 434 may be an abrupt ledge along outer surfaces of the plurality of wall sections, cutting into the outer surfaces inwards, towards the central axis. The diameter of the diffuser 400 downstream of the shoulder 434 may be similar to an inner diameter of an aperture of a dividing wall of a dual blast chamber system, with respect to the aperture 110 of the dividing wall 108 of the dual blast chamber system 132 of FIG. 1, so that the diffuser 400 may be inserted into the aperture. The diameter of the diffuser 400 upstream of the shoulder 434, however, may be larger than the diameter of the aperture of the dividing wall, restricting insertion of the diffuser 400 into the aperture to the shoulder 434. When positioned within a dual blast chamber system, such as the dual blast chamber system 132 of FIG. 1, the shoulder 434 may allow the diffuser 400 to maintain its position within the dual blast chamber system even if the diffuser 400 becomes detached from the barrel end cap 402. For example, the firearms suppressor may be assembled without the diffuser 400 fully threaded into the barrel end cap 402. The shoulder 434 may impinge on the aperture in the dividing wall, inhibiting random motion of diffuser 400 within the dual blast chamber system.

As shown in FIG. 1, a diffuser may be circumferentially surrounded and enclosed within a blast chamber system. A combination of the diffuser and blast chamber system allows the two components to effectively remove particulate matter from a projectile path that may otherwise recirculate through a firearms suppressor and obstruct the central projectile pathway. The diffuser and blast chamber system duo further traps particulate matter outside of the diffuser and inside of the blast chamber system, which may then be easily removed from the firearms suppressor by disassembling the firearms suppressor and cleaning the blast chamber system. A geometry of the blast chamber system and diffuser may be varied without detracting from a function of the blast chamber system and diffuser.

In some examples, a firearms suppressor may include a dual blast chamber system, as shown in FIGS. 1 and 3 in combination with a diffuser to absorb heat, suppress noise, and inhibit accumulation of particulate matter within the projectile path. Other examples, however, may instead be adapted with a single blast chamber system in place of the dual blast chamber system. An example of a single blast chamber system 500 is shown in FIG. 5, coupled at a first, upstream end 506 to a barrel end cap 502 and circumferentially surrounding a diffuser 504. In one example, the barrel end cap 502 and the diffuser 504 may be the barrel end cap 402 and diffuser 400 of FIG. 4. A direction of projectile travel through the single blast chamber system 500 is indicated by arrow 503.

In FIG. 5, the single blast chamber system 500 is depicted with a single blast chamber 508 and has a central axis 501. The single blast chamber system 500 may have a similar shape as the dual blast chamber system. The single blast chamber system 500 may be a hollow cylinder with a diameter, the diameter perpendicular to the central axis 501, adapted to match a diameter of the barrel end cap 502 at downstream section 510 of the barrel end cap 502 that couples directly to the first end 506 of the single blast chamber system 500. The diameter of the single blast chamber system 500 may be uniform along a length of the single blast chamber system 500, the length parallel with the central axis 501.

At least one cut-out opening 512 may be disposed in a surface 514 of the blast chamber 508. The cut-out opening 512 may have a rectangular shape with curved corners and may extend longitudinally along the length of the blast chamber 508 and a width along the circumference of the blast chamber 508. The cut-out opening 512 may extend longitudinally along nearly the entire length of the blast chamber 508 with a portion of the surface 514 remaining at the first end 506 and a portion of the surface 514 remaining at a second, downstream end 516 of the first blast chamber system 500. The width of the cut-out opening 512 may extend along a portion of the circumference of the single blast chamber system 500, such as half or a third of the circumference. In other examples, however, the shape and size of the cut-out opening 512 relative to the length and circumference of the single blast chamber system 500 may vary.

The second end 516 of the single blast chamber system 500 is coupled to an end wall 518, a plane of the end wall 518 arranged perpendicular to the central axis 501. The end wall may be generally circular with a set of straight sides 519. The set of straight sides 519 may be a set of wrench flats that allows a wrench or some other similar tool to be coupled to the set of the straight sides 519 to rotate the single blast chamber system 500 to attach/detach the single blast chambers system 500 to/from the barrel end cap 502.

The end wall 518 may have an aperture 520 disposed in a geometric center of the end wall 518 and centered about the central axis 501. The aperture 520 may be a circular through-hole in the end wall 518 with a diameter that matches an outer diameter of the diffuser 504 at a downstream end 522 of the diffuser 504. The downstream end 522 of the diffuser 504 may be inserted into the aperture 520.

In one example of the single blast chamber system 500, a scrolled sleeve, such as the scrolled sleeve 206 shown in FIG. 2, may extend along the length of the single blast chamber system 500, to interface with a first lip 524 of the barrel end cap 502. In another example, the extension of the scrolled sleeve may be demarcated by a second lip 526 of the barrel end cap 502, the second lip upstream of the first lip 524 and corresponding to a section of the barrel end cap 502 with a wider diameter than the first lip 524. The scrolled sleeve may surround the single blast chamber system 500, entirely enclosing the single blast chamber system 500 along the entire length of the single blast chamber system 500. The scrolled sleeve may similarly enclose a dual blast chamber system, such as the dual blast chamber system 132 of FIG. 1 and 304 of FIG. 3, extending along a full length of the dual blast chamber system and interfacing with a lip of a barrel end cap, such as the barrel end cap 116 of FIG. 1.

Another example of a dual blast chamber system 600 is shown in FIG. 6. The dual blast chamber system 600 may be identical in geometry and similarly used as the dual blast chamber system 132 of FIG. 1, configured with a first blast chamber 602 and a second blast chamber 604, the second blast chamber 604 downstream of the first blast chamber 602. The dual blast chamber system 600 has a central axis 606 and a direction of projectile travel is indicated by arrow 608. A diffuser 610 may be arranged within the dual blast chamber system 600, centered about the central axis 606 and spaced away from an outer shell 612 of the dual blast chamber system 600.

The dual blast chamber system 600 may have a dividing wall 614 between the first blast chamber 602 and the second blast chamber 604 with an aperture 616 through which the diffuser 610 extends. Unlike the diffuser 112 of FIG. 1, however, the diffuser 610 of FIG. 6 continues extending to an end wall 618 of the dual blast chamber system 600. The end wall 618 may be coupled to a downstream end 620 of the dual blast chamber system 600 and have an aperture 622 that is centered about the central axis 606. A downstream end 624 of the diffuser 610 may inserted into the aperture 622 of the end wall 618. Both the aperture 616 of the dividing wall 614 and the aperture 622 of the end wall 618 may have diameters matching an outer diameter of the diffuser 610. The end wall 618 of the dual blast chamber system 600 may have a set of straight sides 626, similar to the set of straight sides 519 of FIG. 5, to allow coupling of the dual blast chamber system 600 to a wrench to attach/detach the dual blast chamber system 600 to/from other components of a firearms suppressor.

A length of the diffuser 610, measured along the central axis 606 may be equal to a length of the dual blast chamber system. The extension of the diffuser 610 into the second blast chamber 604 of the dual blast chamber system 600 may allow increased diversion of particulate matter from the projectile path, decreasing a likelihood of particulate matter movement continuing beyond the dual blast chamber system 600 and into a monocore baffle system. The longer diffuser 610, compared to the diffuser 112 of FIG. 1, may be desirable in a firearm that discharges projectiles at exceptionally high velocities. The dividing wall 614, surrounding the diffuser 610 at a mid-point along a length of the diffuser, the length parallel with the central axis 606, may provide radial support around the diffuser 610. In other words, the dividing wall 614 may provide radial support around a longer diffuser, e.g., the diffuser 610.

FIGS. 1-7 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

In this way a firearms suppressor comprising one or more blast chambers, a slotted diffuser, a monocore baffle system, and a scrolled sleeve, may prevent the accumulation of particulate matter in the path of a projectile travelling through the firearms suppressor. The combination of the aforementioned elements of the firearms suppressor allow a trapping of particulate matter by directing the debris in a one-way path through the diffuser slots resulting in the lamination of particulate matter to inner surfaces of the blast chamber(s) as well as an inner surface of the scrolled sleeve. Efficient cleaning of the firearms suppressor is enabled by the flexibility of the scrolled sleeve. The self-cleaning capability of the diffuser of the firearms suppressor may allow the suppressor to be fired more than 1500 times before a performance of the firearm is adversely affected by accumulation of particulate matter.

The technical effect of adapting the firearms suppressor with a blast chamber system surrounding a diffuser and further enclosed within a scrolled sleeve is that gases entraining particulate matter are propelled radially outwards through the diffuser, compelling the particulate matter to adhere to surfaces of the blast chamber system and scrolled sleeve, thereby immobilizing and removing the particulate matter from a projectile path through the firearms suppressor.

In a first embodiment, a firearms suppressor includes a blast chamber system, a diffuser enclosed by the blast chamber and having a plurality of diffuser wall sections spaced apart by diffuser slots and a scrolled sleeve that circumferentially surrounds the blast chamber and enclosed diffuser, extending along a direction parallel with a central axis of the firearms suppressor, the central axis also a path of projectile travel. In a first example of the firearms suppressor, the blast chamber system is hollow, cylindrical, and concentric about the diffuser and the blast chamber system and the diffuser are both centered about the central axis of the firearms suppressor. A second example of the firearms suppressor optionally includes the first example, and further includes wherein the diffuser has a cylindrical shape defined by the plurality of diffuser wall sections and diffuser slots and wherein the diffuser slots extend along at least a portion of a length of the diffuser wall sections, the length parallel with the central axis. A third example of the firearms suppressor optionally includes one or more of the first and second examples, and further includes wherein the diffuser slots extend radially outwards between the diffuser wall sections, fluidly coupling the path of projectile travel to a space between the diffuser and the blast chamber system. A fourth example of the firearms suppressor optionally includes one or more of the first through third examples, and further includes, wherein the blast chamber system is fixedly coupled to an upstream end of a monocore baffle system, the monocore baffle system extending downstream and away from the blast chamber system, by a continuous outer shell extending from an upstream end of the blast chamber system to a downstream end of the monocore baffle system. A fifth example of the firearms suppressor optionally includes one or more of the first through fourth examples, and further includes, wherein the blast chamber system includes a first blast chamber and a second blast chamber, the first blast chamber arranged upstream of the second blast chamber and separated from the second blast chamber by a dividing wall. A sixth example of the firearms suppressor optionally includes one or more of the first through fifth examples, and further includes, wherein the blast chamber system includes one or more cut-out openings in the outer shell surrounding the first blast chamber and one or more cut-out openings in the outer shell surrounding the second blast chamber. A seventh example of the firearms suppressor optionally includes one or more of the first through sixth examples, and further includes, wherein the one or more cut-out openings extend along a length of the first blast chamber and along a length of the second blast chamber, the length parallel with the central axis, and a width of the one or more cut-out openings extends along a circumference of the outer shell, perpendicular to the central axis, surrounding the first blast chamber and along a circumference of the outer shell surrounding the second blast chamber. An eighth example of the firearms suppressor optionally includes one or more of the first through seventh examples and further includes, wherein the blast chamber system includes one blast chamber. A ninth example of the firearms suppressor optionally includes one or more of the first through eighth examples, and further includes, wherein the scrolled sleeve is a hollow cylinder formed of a coiled sheet of material and wherein the scrolled inner sleeve is coiled along a direction perpendicular to the projectile path and extends from an upstream end of the firearms suppressor to a downstream end of the firearms suppressor. A tenth example of the firearms suppressor optionally includes one or more of the first through ninth examples, and further includes, wherein the scrolled sleeve is flexible in a radial direction towards and away from the central axis. An eleventh example of the firearms suppressor optionally includes one or more of the first through tenth examples, and further includes, wherein the scrolled sleeve coils around itself more than once of a circumference of the scrolled sleeve. A twelfth example of the firearms suppressor optionally includes one or more of the first through eleventh examples, and further includes, wherein the scrolled sleeve has a diameter wider than a diameter of the blast chamber system so that blast chamber system is inserted within the scrolled sleeve.

In another embodiment, a firearm includes a projectile, a barrel providing a trajectory for the projectile and configured to vent exhaust gas, and a suppressor coupled to an end of the barrel and having a blast chamber system circumferentially surrounding a diffuser and positioned upstream of a monocore baffle system, the blast chamber system, diffuser and monocore baffle system enclosed within a flexible scrolled sleeve of the suppressor. In a first example of the firearm, the diffuser has a cylindrical shape formed from a plurality of wall sections separated by a plurality of slots, the wall sections being of identical lengths, widths, and thicknesses. A second example of the firearm optionally includes the first example, and further includes, wherein each slot of the plurality of slots has a width allowing passage of particulate matter in a radially outward direction, away from the projectile path. A third example of the firearm optionally includes one or more of the first and second examples, and further includes, wherein the scrolled sleeve is formed from a bendable and heat-resistant material.

In another embodiment, a sound suppressing device includes a blast chamber system at an upstream end of the device, relative to a direction of projectile motion, having at least one set of openings in an outer surface of the blast chamber system, a diffuser, enclosed within the blast chamber system, having a plurality of slots extending radially outwards through a surface of the diffuser, a monocore baffle system continuously and fixedly coupled to the blast chamber system, downstream of the blast chamber system, and a scrolled sleeve circumferentially surrounding the blast chamber system and monocore baffle system. In a first example of the device, the scrolled sleeve is adapted to be removable from a rigid outer housing of the sound suppressing device. A second example of the device optionally includes the first examples, and further includes wherein a path of projectile travel through the firearms suppressor is defined by an inner passage of the diffuser, one or more apertures in the blast chamber system, and one or more apertures in the monocore baffle system, the inner passage and the one or more apertures of both the blast chamber system and the monocore baffle system aligned along the central axis.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A firearms suppressor, comprising;

a blast chamber system;

a diffuser enclosed by the blast chamber and having a plurality of diffuser wall sections spaced apart by diffuser slots; and a scrolled sleeve that circumferentially surrounds the blast chamber and enclosed diffuser, extending along a direction parallel with a central axis of the firearms suppressor, the central axis also a path of projectile travel;

wherein the scrolled sleeve is a hollow cylinder formed of a coiled sheet of material and wherein the scrolled sleeve is coiled along a direction perpendicular to the projectile path and extends from an upstream end of the firearms suppressor to a downstream end of the firearms suppressor; and wherein the scrolled sleeve coils around itself more than once around a circumference of the scrolled sleeve.

2. The firearms suppressor of claim 1, wherein the blast chamber system is hollow, cylindrical, and concentric about the diffuser and the blast chamber system and the diffuser are both centered about the central axis of the firearms suppressor.

3. The firearms suppressor of claim 2, wherein the diffuser has a cylindrical shape defined by the plurality of diffuser wall sections and diffuser slots and wherein the diffuser slots extend along at least a portion of a length of the diffuser wall sections, the length parallel with the central axis.

4. The firearms suppressor of claim 3, wherein the diffuser slots extend radially outwards between the diffuser wall sections, fluidly coupling the path of projectile travel to a space between the diffuser and the blast chamber system.

5. The firearms suppressor of claim 1, wherein the blast chamber system is fixedly coupled to an upstream end of a monocore baffle system, the monocore baffle system extending downstream and away from the blast chamber system, by a continuous outer shell extending from an upstream end of the blast chamber system to a downstream end of the monocore baffle system.

6. The firearms suppressor of claim 5, wherein the blast chamber system includes a first blast chamber and a second blast chamber, the first blast chamber arranged upstream of the second blast chamber and separated from the second blast chamber by a dividing wall.

7. The firearms suppressor of claim 6, wherein the blast chamber system includes one or more cut-out openings in the outer shell surrounding the first blast chamber and one or more cut-out openings in the outer shell surrounding the second blast chamber.

8. The firearms suppressor of claim 7, wherein the one or more cut-out openings extend along a length of the first blast chamber and along a length of the second blast chamber, the length parallel with the central axis, and a width of the one or more cut-out openings extends along a circumference of the outer shell, perpendicular to the central axis, surrounding the first blast chamber and along a circumference of the outer shell surrounding the second blast chamber.

9. The firearms suppressor of claim 5, wherein the blast chamber system includes one blast chamber.

10. The firearms suppressor of claim 1, wherein the scrolled sleeve is flexible in a radial direction towards and away from the central axis.

11. The firearms suppressor of claim 1, wherein the scrolled sleeve has a diameter wider than a diameter of the blast chamber system so that blast chamber system is inserted within the scrolled sleeve.

12. A firearm, comprising;

a projectile;

a barrel providing a trajectory for the projectile and configured to vent exhaust gas; and a suppressor coupled to an end of the barrel and having a blast chamber system circumferentially surrounding a diffuser and positioned upstream of a monocore baffle system, the blast chamber system, diffuser and monocore baffle system enclosed within a flexible scrolled sleeve of the suppressor;

wherein the scrolled sleeve is coiled along a direction perpendicular to a projectile path and extends from an upstream end of the firearms suppressor to a downstream end of the firearms suppressor; and wherein the scrolled sleeve coils around itself more than once around a circumference of the scrolled sleeve.

13. The firearms suppressor of claim 12, wherein the diffuser has a cylindrical shape formed from a plurality of wall sections separated by a plurality of slots, the wall sections being of identical lengths, widths, and thicknesses.

14. The firearms suppressor of claim 13, wherein each slot of the plurality of slots has a width allowing passage of particulate matter in a radially outward direction, away from the projectile path.

15. The firearms suppressor of claim 12, wherein the scrolled sleeve is formed from a bendable and heat-resistant material.

16. A sound suppressing device, comprising;

a blast chamber system at an upstream end of the device, relative to a direction of projectile motion, having at least one set of openings in an outer surface of the blast chamber system;

a diffuser, enclosed within the blast chamber system, having a plurality of slots extending radially outwards through a surface of the diffuser;

a monocore baffle system continuously and fixedly coupled to the blast chamber system, downstream of the blast chamber system; and a scrolled sleeve circumferentially surrounding the blast chamber system and monocore baffle system, wherein the scrolled sleeve is coiled along a direction perpendicular to a projectile path; and wherein the scrolled sleeve coils around itself more than once around a circumference of the scrolled sleeve.

17. The sound suppressing device of claim 16, wherein the scrolled sleeve is adapted to be removable from a rigid outer housing of the sound suppressing device.

18. The sound suppressing device of claim 17, wherein the projectile path through the firearms suppressor is defined by an inner passage of the diffuser, one or more apertures in the blast chamber system, and one or more apertures in the monocore baffle system, the inner passage and the one or more apertures of both the blast chamber system and the monocore baffle system aligned along the central axis.

* * * * *